United States Patent [19]

Daito et al.

[11] 4,275,527

[45] Jun. 30, 1981

[54] CENTERLESS GRINDING MACHINE

[75] Inventors: Michimasa Daito, Hama-matsu; Tohru Sugino, Shizuoka, both of Japan

[73] Assignee: Nissin Machine Works, Ltd., Japan

[21] Appl. No.: 58,512

[22] Filed: Jul. 18, 1979

[51] Int. Cl.[3] ..... B24D 5/18

[52] U.S. Cl. ..... 51/103 TF; 51/165.87; 51/165.92; 51/238 CG

[58] Field of Search ..... 51/103 R, 103 WH, 103 TF, 51/165.87, 165.92, 238 CG

[56] References Cited

U.S. PATENT DOCUMENTS

| | | | |
|---|---|---|---|
| 944,902 | 12/1909 | Nichols | 51/165.87 |
| 1,991,953 | 2/1935 | Nenninger | 51/165.87 |
| 2,861,399 | 11/1958 | Lundius | 51/103 R |
| 2,979,869 | 4/1961 | Birleson | 51/103 TF |
| 3,001,336 | 9/1961 | Bauer | 51/103 TF |
| 4,055,027 | 10/1977 | Freddi | 51/103 WH |

*Primary Examiner*—Harold D. Whitehead
*Attorney, Agent, or Firm*—Holman & Stern

[57] ABSTRACT

A centerless grinding machine which comprises a grinding wheel, a regulating wheel, a blade and an in-process gaging device and in which said gaging device includes a pair of feelers each having a contact adapted to contact each one of the wheels and the blade is provided with a rectangular opening or slot having dimensions sufficient to freely receive the contacts so that interference between the wheels, blade workpieces and contacts is prevented. One of said feelers contacts the periphery of said grinding wheel in a peripheral position below by the distance of center height of the workpiece and the other feeler contacts the periphery of said regulating wheel in a position below the position where the first-mentioned feeler contacts the periphery of the grinding wheel.

4 Claims, 7 Drawing Figures

CENTERLESS GRINDING MACHINE

BRIEF SUMMARY OF THE INVENTION

This invention relates to a centerless grinding machine and more particularly, to an improved in process gaging device for through-feed grinding operation on the centerless grinding machine.

A centerless grinding machine principally comprises a grinding wheel, a regulating wheel and a blade and is suitably employed for grinding simple cylindrical workpieces such as piston pins, cylindrical rollers and the like on through-feed operation. The workpieces are fed to the machine continuously by the feed component of the regulating wheel resulted from the tilting of the regulating wheel.

The finished size of the workpieces can be varied by operating the adjusting handle on the workpiece table when the finished size of the workpieces deviates from a predetermined value due to wear of the grinding wheel and/or thermal deformation of the machine structure.

That is, since the finished size of workpieces varies with the lapse of time, it is necessary to periodically measure the workpieces being ground and compensate for the position of the table based on the result of measurement. However, the measuring and compensating operations to be performed by the machine operator are time consuming and troublesome ones. Therefore, a strong desire has long existed that the feed and discharge of workpieces and the dressing of the grinding wheel as well as control of variations in size be automatically performed.

In the centerless through feed grinding machine comprising a grinding wheel a, a regulating wheel b and a blade c as shown in FIGS. 1 and 2, the outer diameter of workpieces is automatically detected or measured by postprocess gauges d, e and the position of the table is compensated for based on the measurement result. However, such a conventional grinding machine has a number of technical disadvantages such as difficulties in controlling the size of workpieces ground by the grinding wheel immediately after the dressing of the wheel, for example and has not been widely employed.

It has been well known in the art that the desired finished size of workpieces to be ground on the through-feed operation in a centerless grinding machine is determined by the distance between the grinding wheel and regulating wheel in the grinding machine.

More particularly, in the through-feed operation, the so-called spark-out grinding is performed as the workpieces pass between the two wheels and in the grinding about one third to one half of the width of the grinding wheel measured from the feeding edge thereof is employed for about 80% of stock removal and the two thirds to one half of the wheel width is employed for about 20% of stock removal.

Thus, the desired finished size of workpieces is determined by the distance between the grinding wheel and regulating wheel on the discharge side of the two wheels where the spark-out grinding on the workpieces terminates. Therefore, it will be understood that the desired finished size of workpieces can be controlled by varying the distance between the grinding wheel and regulating wheel on the through-feed operation.

Therefore, one major object of the present invention is to control the size of workpieces based on the result of measurement on the distance between the wheels in process.

Another object of the present invention is to determine the distance between the surface of the grinding wheel and regulating wheel by measuring variations of the position of the surface of the grinding wheel rotating at a higher speed and the regulating wheel rotating at a lower speed by the measuring heads which are in contact with the peripheries of the two wheels and summing the values obtained by the two measuring heads.

A further object of the present invention is to provide a centerless grinding machine in which the center of workpieces and the contacts of the measuring heads are disposed in symmetrical positions against the infeed direction on the periphery of the grinding wheel so as not to cause any size deviation of workpieces notwithstanding continuous decrease of wheel diameter.

A further object of the present invention is to provide a centerless grinding machine in which the blade is provided with a rectangular slot in which the contacts of fingers are freely received so that interference between the two wheels, works, blade and guide plate can be prevented.

According to the present invention, there is provided a centerless grinding machine which comprises a grinding wheel, a regulating wheel, a blade positioned for supporting the workpiece, a gaging device disposed on the discharge side of the grinding and regulating wheels for compensating for variations in the positions of the surfaces of both wheels and discharge conveyors disposed on the discharge side of the grinding and regulating wheels for receiving and discharging ground workpieces from the grinding machine, the gaging device including a first detector adapted to detect variations in the position of the surface of the said grinding wheel and having a first head, a first finger connected at one end to the first head and a contact connected to the other end of the first finger for engaging the grinding wheel and a second detector adapted to detect variations in the the position of the surface of the regulating wheel, having a second head, a second finger connected at one end to the second head and a second contact connected to the other end of the second finger for engaging the regulating wheel and the blade being provided with a slot or opening having dimensions larger than the combined length and height of the first and second contacts to freely receive the contacts, further comprising a common slide block fixedly secured to a mounting base for finely adjusting the positions of the first and second heads.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

DETAILED DESCRIPTION

Figure 1:
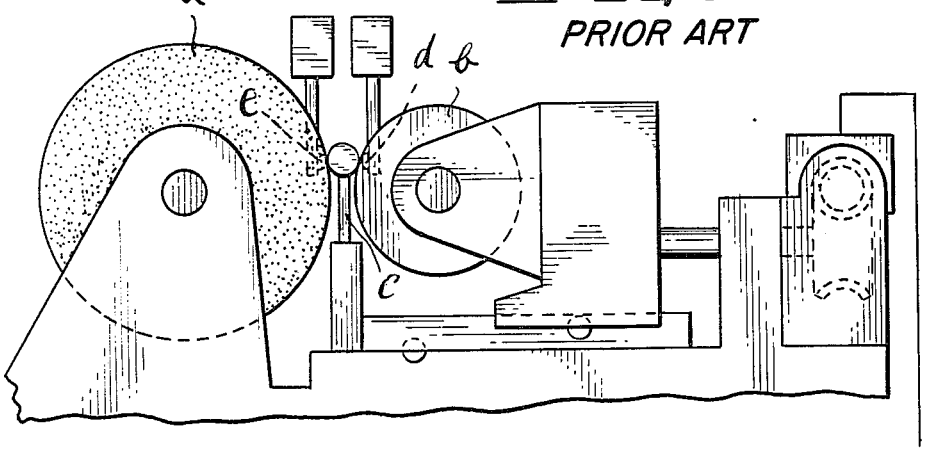
FIG. 1. PRIOR ART
FIG. 1 is a schematic front elevational view of a conventional centerless grinding machine.
Figure 2:
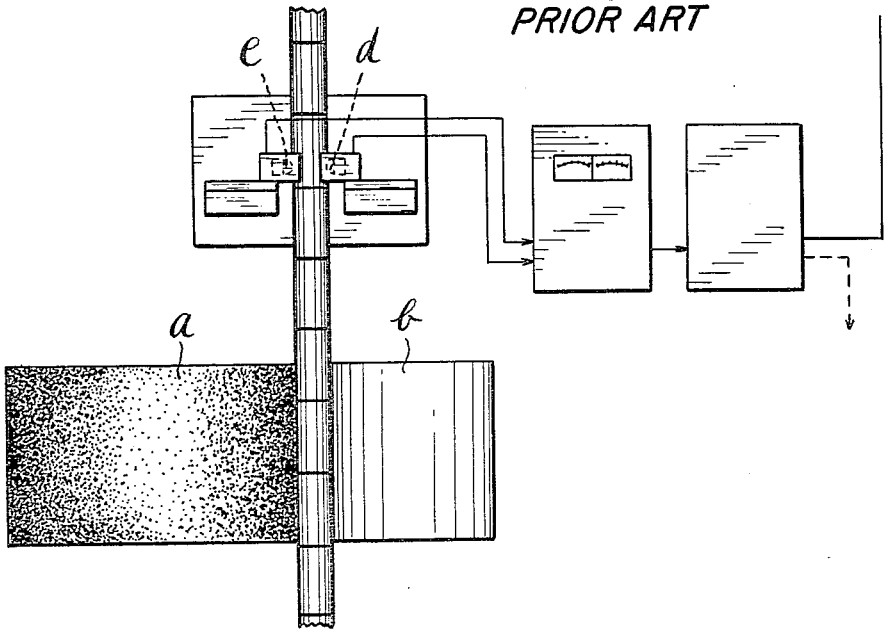
FIG. 2. PRIOR ART
FIG. 2 is a plan view of said centerless grinding machine as shown in FIG. 1.
Figure 3:
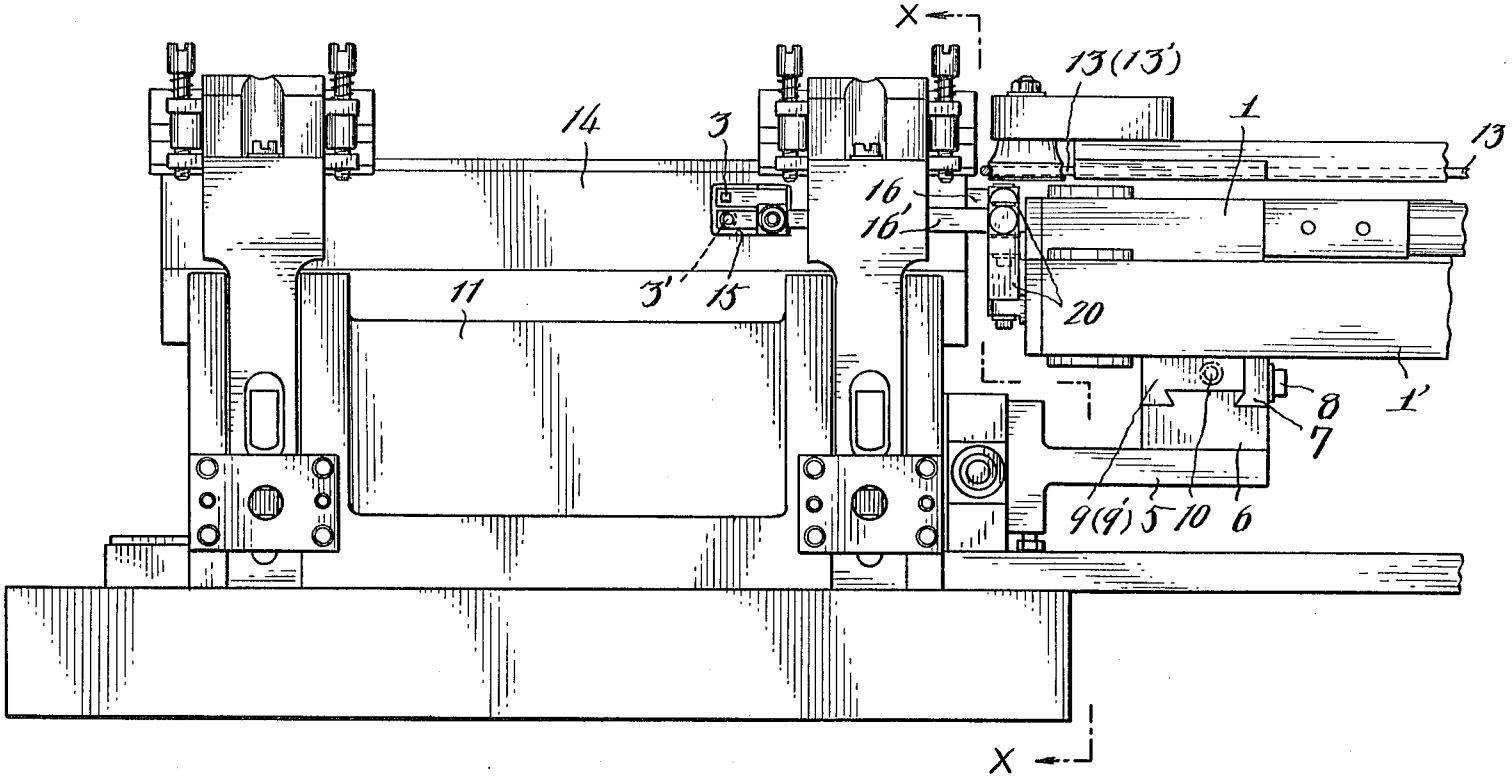
FIG. 3 is a side elevational view of one preferred embodiment of the measuring heads of the centerless grinding machine constructed in accordance with the present invention.
Figure 4:
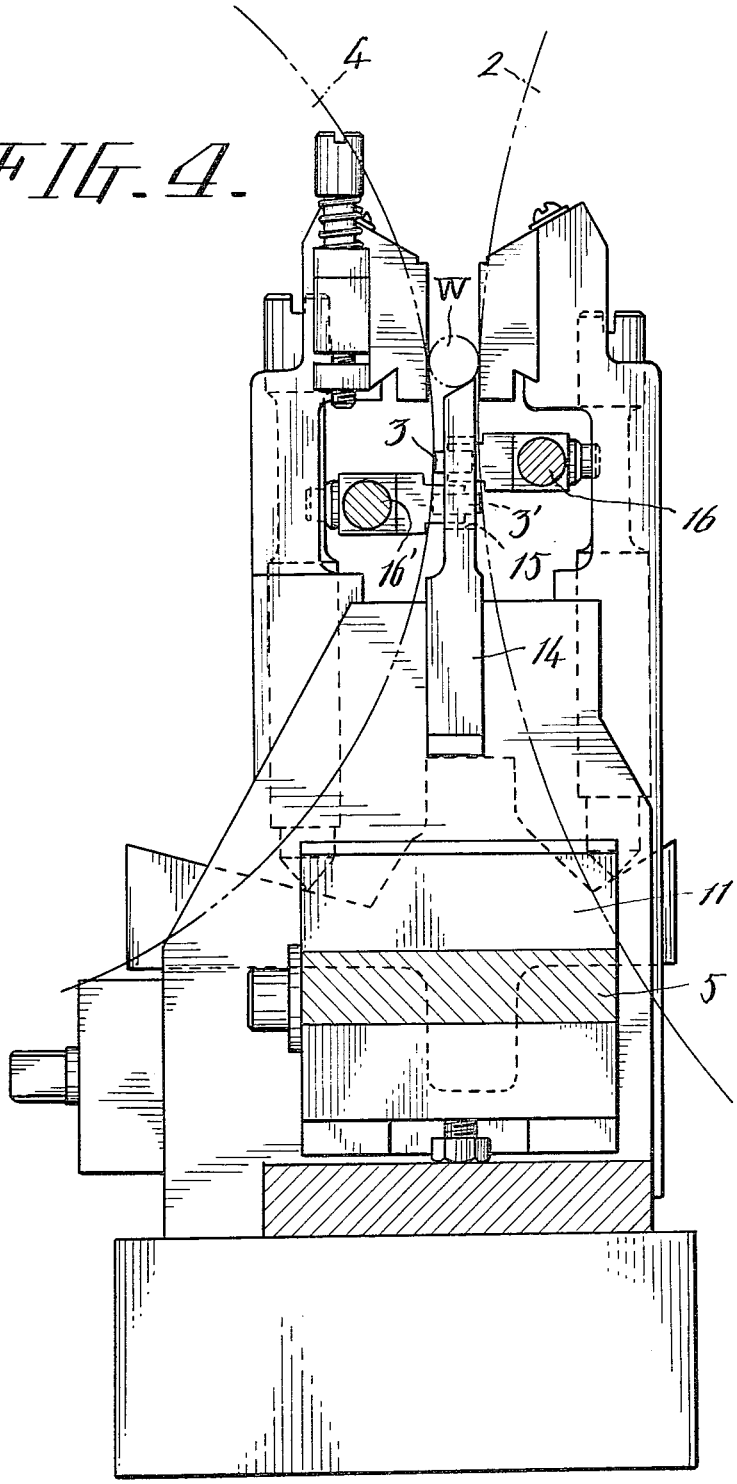
FIG. 4 is a vertical partly sectional view on an enlarged scale taken along substantially the line X—X of FIG. 3.
Figure 5:
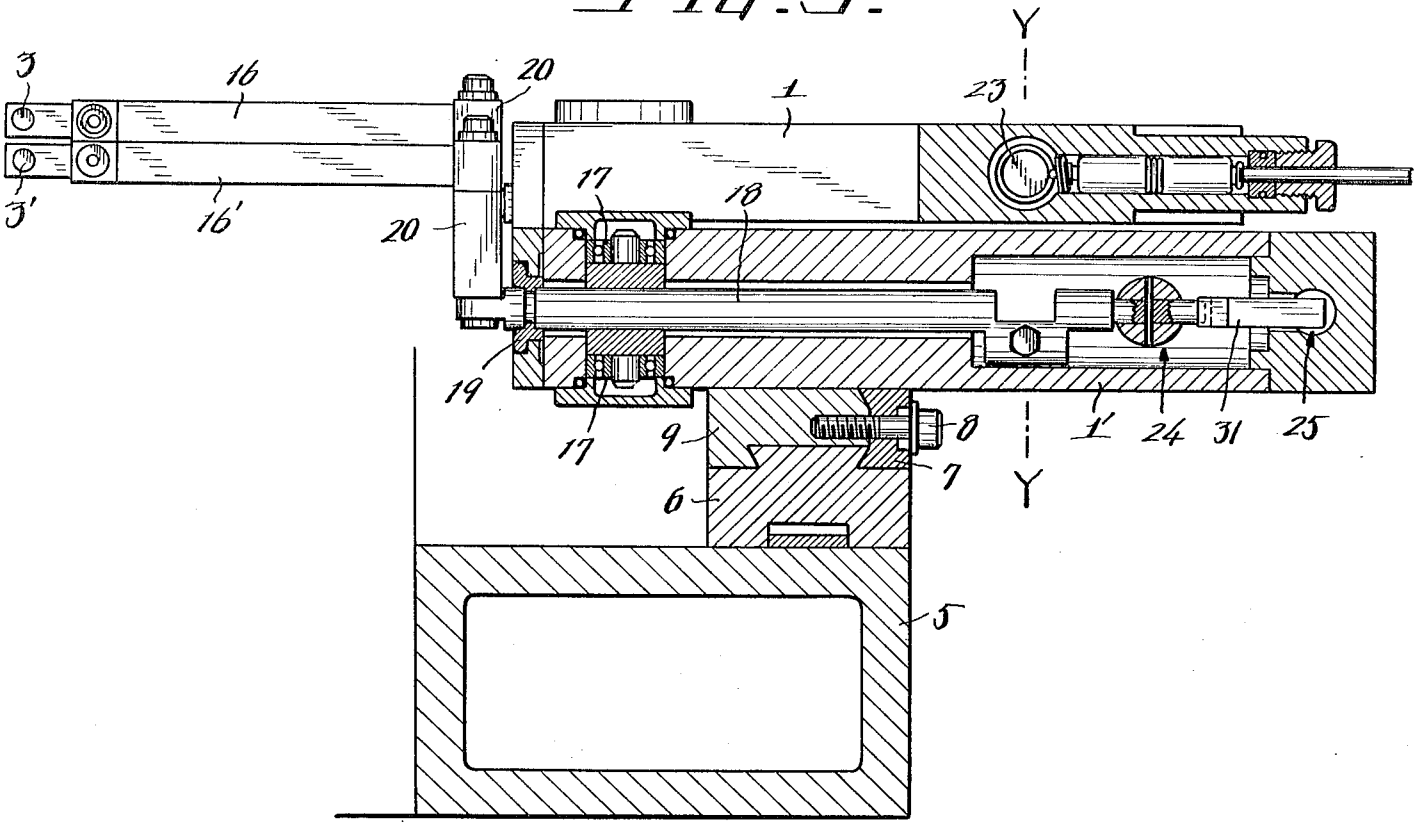
FIG. 5 is a fragmentary longitudinal sectional view of said measuring heads as shown in FIG. 3.

The present invention will be now described referring to FIGS. 3 through 7 of the accompanying drawings in which one preferred embodiment of the measuring heads of the centerless grinding machine constructed in accordance with the present invention is shown for illustration purposes, but not for limiting the scope of the same in any way.

Reference numerals 1 and 1' denote a pair of measuring heads disposed in different heights on the discharge side of a grinding wheel 2 and a regulating wheel 4 for measuring variation of the position of surface of the grinding wheel 2 and regulating wheel 4, respectively. The contact 3' of the measuring head 1' is adapted to measure variation of the position of the surface of the grinding wheel 2 in a position below the center of the grinding wheel 2 by the distance of the center of the workpiece above the center of the grinding wheel and the contact 3 of the measuring head 1 is adapted to measure variation of the position of the surface of the regulating wheel 4 in a position just above the position where the contact 3 of the head 1 engages the grinding wheel 2 to measure variation of the position of the surface of the regulating wheel. The measuring heads 1 and 1' are mounted on slidable members 9, 9' which are slidably guided along a common slide block 6 fixedly secured to a mounting base 5 and the slidable members 9, 9' are adapted to be held in position on the slide block 6 by means of a clamp 7 and threaded fastening rods 8. A threaded feed rod 10 is in threaded engagement with the threaded bore formed in each of the slidable members 9, 9' so that the position of the measuring head 1 or 1' associated therewith can be finely adjusted.

The above-mentioned mounting base 5 is fixedly secured to a workrest 11 to which a blade 14 is attached.

Provided above the measuring heads 1 and 1' are discharge conveyor belts 13, 13' which are at the opposite ends trained about pulleys (not shown) to discharge ground workpieces W out of the machine and the conveyor belts 13, 13' are driven by a suitable drive means (not shown).

The upper end or exit portion of the blade 14 attached to the workrest 11 is provided with an elongated slot 15 which has dimensions larger than the combined length and height of the two head contacts 3, 3' for receiving the above-mentioned contacts 3, 3' secured at the leading ends of the fingers 16, 16' extending laterally from the measuring heads 1, 1', respectively to thereby prevent the interference between the two contacts in the clearance defined between the grinding and regulating wheels 2 and 4 (however, the elongated slot 15 is not absolutely necessary when a space sufficient to receive the contacts depending is available the diameter of workpieces W to be ground in the centerless grinding machine).

As mentioned hereinabove, since the positions of the measuring heads 1, 1' in the feed direction of the table can be adjusted, before the blade 14 is attached to the workrest 11, both wheels and heads are spaced from each other to provide a space sufficient to receive the blade. The blade 14 is attached to the workrest 11 so as to extend the blade into the space, the measuring heads 1 and 1' are moved toward each other so that the contacts 3 and 3' associated with the heads 1 and 1', respectively, can be received into the elongated slot 15 in the blade 14 and the grinding wheel 2 and regulating wheel 4 are moved toward each other until a space of value corresponding to a desired size of workpieces W to be ground in the grinding machine has been attained between the two wheels. While maintaining the contacts 3' and 3 in contact with the grinding wheel 2 and regulating wheel 4, respectively, the positions of the measuring heads 1 and 1' are so determined that the heads are disposed in the center area of the measuring range of the gaging device.

Each of the pair of measuring heads 1 and 1' has an arm 18 which is at one end journalled in precision ball bearings 17 therein and a flexible diaphragm seal 19 is provided at the journalled end of the arm 18 to seal the arm and associated head. The extension of the journalled end of the arm 18 has secured thereto by means of a threaded rod a spacer 20 adapted to determine the position of the associated head 1 or 1' in the vertical direction and the above-mentioned finger 16 or 16' having a length greater than the guide plate (not shown) is secured to the spacer 20 by means of a threaded rod. Furthermore, the above-mentioned contact 3 or 3' of wear-resisting material is in turn secured to the outer or leading end of the finger 16 or 16' by means of a threaded rod.

A thrust spring 22 is provided on one side of the arm 18 within the associated head to set the pressure of contact and one electric displacement detector 23 utilizing a differential transformer or the like acts on the side of the arm 18 opposite to the spring 22. Furthermore, the other end of the arm 18 is provided with a damper means 24 adapted to hold the arm at the other end against the springing-up of the arm to thereby stabilize the indication of measurement result and an arm retraction means 25 adapted to retract the associated contact away from the grinding wheel 2 or regulating wheel 4.

The damper means 24 includes seal rings 27 which are secured to the arm 18 through damper brackets 26 and a pair of diametrically opposite seal holders 28 secured to the head 1 or 1' abut against the outer peripheries and the inner sides of the seal rings 27 to hold the latter in position. Thus, as the arm 18 oscillates, the inner sides of the seal rings 27 frictionally deform to thereby damp the oscillation of the arm 18.

Figure 6:
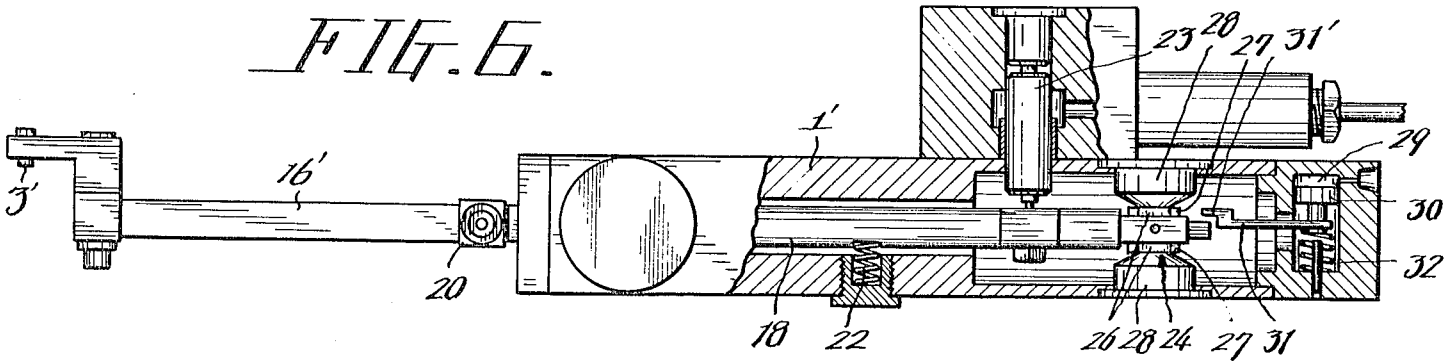
FIG. 6 is a plan view of FIG. 5 showing a portion thereof in cross-section.
Figure 7:
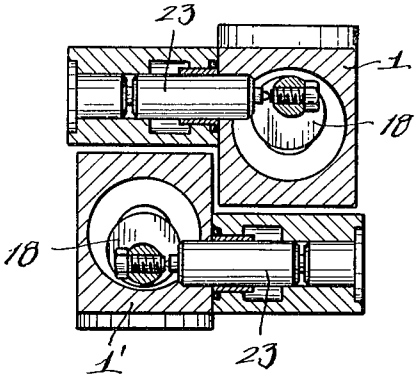
FIG. 7 is a vertical sectional view taken along substantially the line Y—Y of FIG. 5.

The retraction means 25 associated with the contact 3 or 3' includes a pneumatic micro-cylinder 29 provided at the rear end of the associated head 1 or 1' and having a piston 30 and a lever 31 connected at one end or the inner end of the rod of the piston 30 and having a bent portion 31' at the other end to engage the adjacent end of the arm 18. A return spring 32 abuts against the side of the lever 31 opposite to the piston 30. With the above-mentioned construction and arrangement of the components of the retraction means, when air pressure is applied to one or the upper end of the cylinder 29 (as seen in FIG. 6), the piston 30 displaces downwardly as seen in FIG. 6 against the force of the spring 32 which in turn moves the contacts 3 or 3' of the head 1 or 1' away from the periphery of the grinding wheel 2 or regulating wheel 4. When the supply of the air pressure to the cylinder 29 is interruped, the piston 30 returns to the initial position under the force of the spring 32 and accordingly, the lever 31 also displaces upwardly following the upward movement of the piston to disengage the bent portion 31' from the arm 18 to thereby release the arm 18.

In the operation of the centerless grinding machine of the present invention as mentioned hereinabove, the pair of measuring heads 1 and 1' are disposed on the exit side of the grinding wheel 2 and regulating wheel 4, the measuring head units 1, 9 and 1', 9' are slidably mounted on the slide block 6, the slidable members 9, 9' are moved along the slide block 6 by means of the feed screws or threaded rods 10 until the measuring heads 1 and 1' are positioned in the center area of the measuring range of the sizing device where the contacts 3' and 3 of the heads 1' and 1 are received in the slot 15 in the blade 14 and contact the grinding wheel 2 and regulating wheel 4, respectively and are then held in position by fastening the clamp 7, a clearance is defined between the grinding wheel 2 and regulating wheel 4 corresponding to a desired finish size of workpieces and the grinding wheel 2 and regulating wheel 4 are rotated. As the grinding wheel 2 and regulating wheel 4 are rotated, the workpiece W supported at the upper end of the blade 14 is subjected to a feed component from the regulating wheel 4 to be abutted against the grinding wheel 2 to be continuously ground thereby. The ground workpieces W are transferred onto the conveyor belts 13, 13' on the exit side of the wheels 2 and 4 to be discharged out of the machine.

Although the present invention has been described as being applied to a centerless through feed grinding operation for a constant size, the invention is equally applied to other grinding operations as those performed by centerless plunge grinding machines and double disc surface grinding machines, for example.

According to the present invention, since the distance between the grinding wheel 2 and regulating wheel 4 is measured and the distance is varied so as to correspond to different diameters of workpieces to be ground by the centerless grinding machine, the grinding machine can be applied to the plunge grinding of small diameter workpieces. On the other hand, in the centerless plunge grinding machines with a conventional in-process gage, a portion of the blade is cut away to prevent interference between the blade and the workpiece and the two contacts of the measuring heads are positioned to contact a workpiece to detect the size of the workpiece being ground to thereby control the feed means in accordance with the measuring result. Thus the conventional in process gages for centerless plunge grinding machines are not applicable to the grinding of workpieces with diameters which are smaller than the width of the contacts. According to the present invention, the interference between the movement of a workpiece and the contacts of the sizing device when the workpiece is fed into and discharged from the clearance between the grinding wheel and regulating wheel, as frequently seen in the conventional centerless plunge grinding machines, is prevented. Furthermore, according to the present invention, the detectors are positioned below a workpiece to be ground to shorten the cycle time of the grinding machine.

Since the distance between the two rotating wheels determines the finished size of workpieces to be ground according to the present invention, the sophisticated computing processes in which the size and taper of adjacent workpieces is measured and the distance is adjusted based on an average value of the measured results of the workpieces is eliminated and the workpieces can be automatically and uniformly ground with high precision.

Furthermore, in the centerless grinding machine of the present invention, since the indication of the gaging device deviates by the actual amount of dressing after the dressing of the grinding wheel, and the distance between the grinding wheel and regulating wheel is adjusted until the distance reaches a predetermined standard value, when the distance is adjusted by the employment of a pulse motor and the number of steps is counted, the actual dressing amount can be easily determined.

While only one embodiment of the invention has been shown and described in detail, it will be understood that the same is for illustration purpose only and not to be taken as a definition of the invention, reference being had for this purpose to the appended claims.

What is claimed is:

1. In a centerless grinding machine comprising a rotatably mounted grinding wheel, a rotatably mounted regulating wheel opposing said grinding wheel in spaced relationship to the grinding wheel to define a clearance between the wheels corresponding to a desired finished size of a workpiece to be ground by said grinding machine, a blade positioned in said clearance to support said workpiece and a gaging device for detecting variations in the positions of the surfaces of the grinding and regulating wheels, the improvement comprising a gaging device having a first detector adapted to detect variations in the position of the surface of said grinding wheel and having a first measuring head, a first finger member connected at one end of said first measuring head and a contact connected to the other end of said first finger engaging the grinding surface of said grinding wheels, a second detector adapted to detect variations in the position of the surface of said regulating wheel and having a second measuring head, a second finger connected at one end to said second measuring head and a second contact connected to the other end of said second finger engaging the surface of said regulating wheel, said blade being provided with an opening having dimensions larger than the combined length and height of said first and second contacts to freely receive said contacts, and further comprising a common slide block fixedly secured to a mounting base, said first and second measuring heads being adjustably mounted on said slide block for finely adjusting the positions of said first and second heads, and discharge conveyors disposed on said discharge side of the grinding and regulating wheels for receiving and discharging ground workpieces from said grinding machine.

2. The centerless grinding machine as set forth in claim 1, wherein said first contact engages the periphery of said grinding wheel in a position below the center of the grinding wheel by the distance of the center of the workpiece above the center of the grinding wheel, and said second contact engages the periphery of said regulating wheel in a position just above the position wherein said first contact engages the periphery of the grinding wheel.

3. The centerless grinding machine as set forth in claim 1, in which each of said first and second heads is mounted on a slidable adjusting member which is slidably mounted on said common slide block to be guided along said block to thereby finely adjust the position of the associated head.

4. The centerless grinding machine as set forth in claim 3, in which said fine adjustment of the position of each of said heads is effected by means of a threaded rod in threaded engagement in the associated slidable adjusting member, and means operatively associated with each said measuring head and connected to said one end of each said finger to detect displacement of each respective contact.

* * * * *